United States Patent [19]

Giannone

[11] Patent Number: 4,541,146

[45] Date of Patent: Sep. 17, 1985

[54] CINCHING CLAMP DEVICE AND METHOD OF ATTACHMENT

[75] Inventor: Charles Giannone, N. Babylon, N.Y.

[73] Assignee: Duro Dyne Corporation, Farmingdale, N.Y.

[21] Appl. No.: 586,335

[22] Filed: Mar. 5, 1984

[51] Int. Cl.[4] ..... B65D 63/02

[52] U.S. Cl. ..... 24/20 R; 24/20 EE; 24/22; 24/23 EE

[58] Field of Search ..... 24/20 R, 20 CW, 20 EE, 24/20 W, 22, 23 B, 23 EE, 23 W, 16 PB; 140/123.6, 93.2; 248/231, 300

[56] References Cited

U.S. PATENT DOCUMENTS

| | | | |
|---|---|---|---|
| Re. 14,762 | 11/1919 | Springer | 24/23 EE |
| 152,424 | 6/1874 | Scott | 24/20 EE |
| 916,673 | 3/1909 | Clawson | 24/20 R |
| 1,084,407 | 1/1914 | Deist | 24/20 EE |
| 1,099,460 | 6/1914 | McFarland | 24/20 EE |
| 1,173,998 | 2/1916 | Depew | 24/23 W |
| 1,190,667 | 7/1916 | O'Riordan | 24/20 EE |
| 2,291,773 | 8/1942 | Taylor | 24/23 EE |
| 3,078,532 | 2/1963 | Bywater | 24/22 |
| 3,660,869 | 5/1972 | Caveney et al. | 24/16 PB |
| 4,009,509 | 3/1977 | McCormick | 24/16 PB |

FOREIGN PATENT DOCUMENTS

| | | | |
|---|---|---|---|
| 11627 | 4/1908 | United Kingdom | 24/23 W |

*Primary Examiner*—Victor N. Sakran

*Attorney, Agent, or Firm*—Mark T. Basseches; Paula T. Basseches

[57] ABSTRACT

An integral and inexpensive tying or bundling clamp device is disclosed, together with the method of applying the same. The clamp comprises a metal band having at one end an anchor defined by a series of convolutions of the band wrapped to provide a passage for the free end of the band. The device is applied by encircling an article and passing the free end through the passage and tightening the band while applying a reacting pressure against the convolutions, whereby the same are caused to constrict and frictionally to retain the band in the anchor.

4 Claims, 13 Drawing Figures

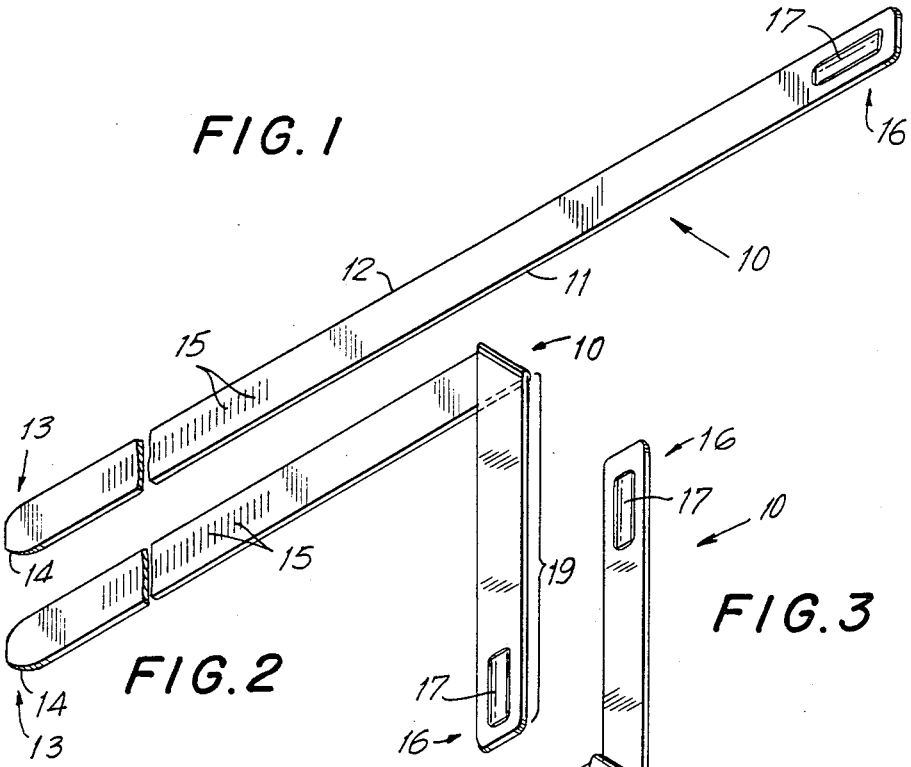
FIG. 1
FIG. 2
FIG. 3
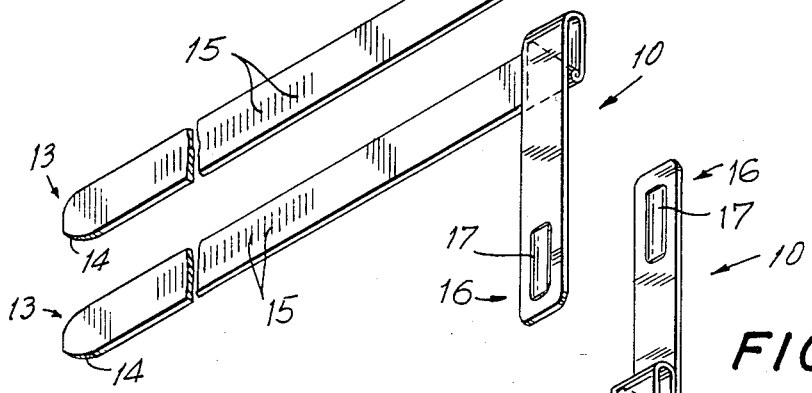
FIG. 4
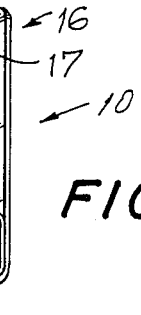
FIG. 5
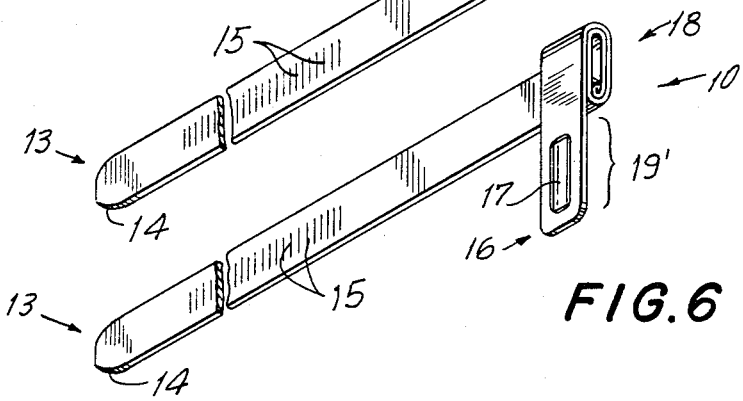
FIG. 6

FIG. 7
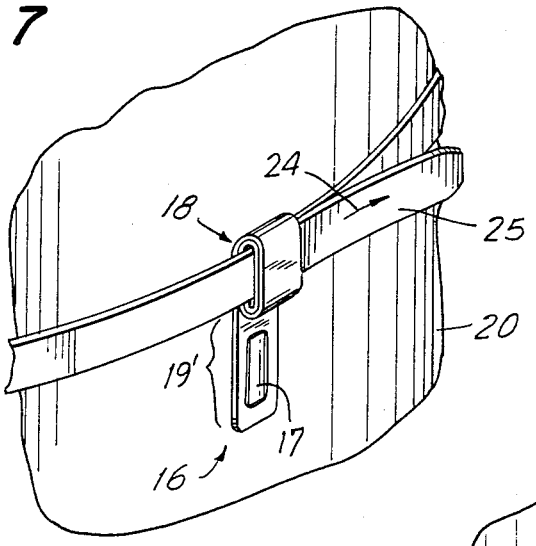
FIG. 8
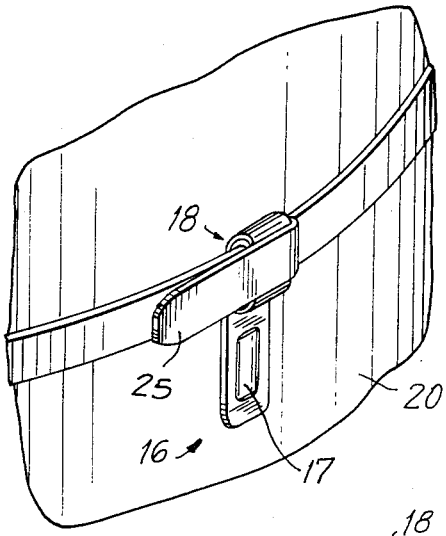
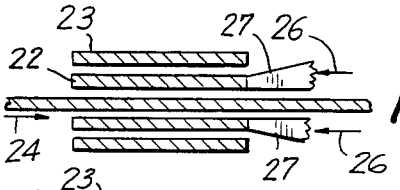
FIG. 12
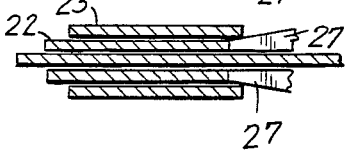
FIG. 13
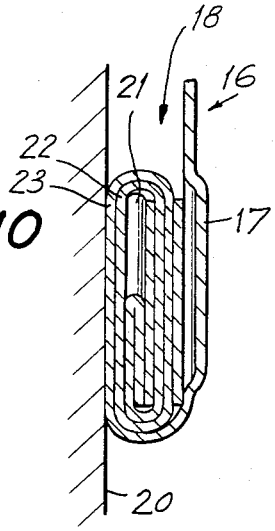
FIG. 10
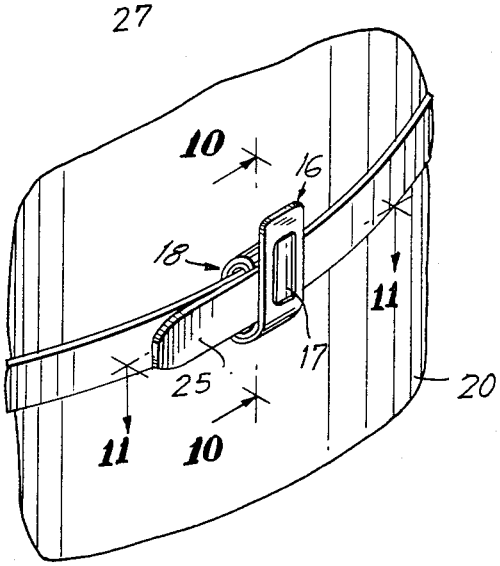
FIG. 9
FIG. 11
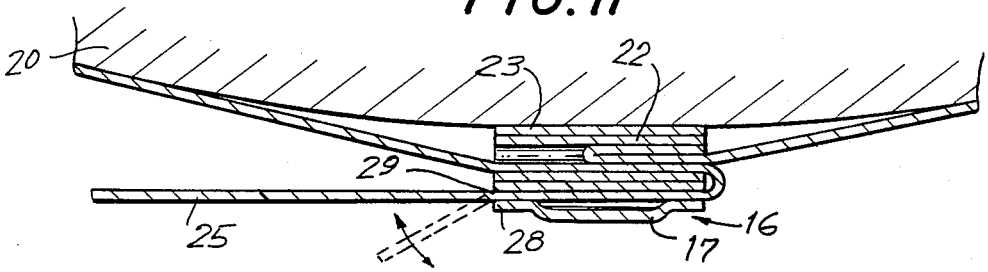

CINCHING CLAMP DEVICE AND METHOD OF ATTACHMENT

BACKGROUND OF THE INVENTION

1. Field of the Invention

The present invention pertains to a cinching device and more particularly to a metallic band adapted to be looped about objects to be bundled or interconnected and subsequently tightened to maintain the embraced articles in a fixed position.

2. The Prior Art

Conventionally available clamp devices of the noted type fall into two general classifications.

There are clamp devices formed of polymeric material which include an elongate strap component having an integral eye or anchor portion at one end. Devices of this type are illustrated, by way of example, in U.S. Pat. No. 3,660,869, issued May 9, 1972, and U.S. Pat. No. 4,009,509, issued Mar. 1, 1977. Such devices typically include a multiplicity of transversely directed teeth along the length of the strap on one surface thereof. The eye or anchor end includes a pawl which is angularly oriented with respect to the teeth in such manner that the teeth are permitted to pass freely through the eye in one direction, with a consequent deflection of the pawl. The geometry of the pawl and teeth is arranged to preclude retractile movement of the band through the anchor.

When the device is tightened about an article or articles to be connected, i.e. a hose or flexible connector fitting sleeved over a duct end, etc. the tightened band functions to compress the outer encircling component against the duct so as to prevent fluid leaks from the spaces between the components.

A further conventionally available clamp device is comprised of an elongate metal strip having a multiplicity of closely spaced perforations angularly oriented relative to the longitudinal axis of the strip. One end of the strip carries a fixture in which is rotatably mounted the equivalent of a worm gear or thread, the periphery of which is inclined relative to the longitudinal axis of the strip to correspond with the angles of the perforations in the strip.

The device is used, for instance, as a hose clamp by encircling the strip about a hose which has been sleeved over a pipe. The free end of the strip is passed into a restricted space beneath the worm gear, the threaded component of which enters into sequential perforations of the band. When the worm is rotated, the strip is progressively tightened about the hose, thus to clamp the hose against the encircled duct or pipe.

As will be appreciated from the foregoing general description, both the plastic strip and the metal clamping or strap devices described incorporate means which prevent the tightened strap from backing off through the anchor or aperture after tightening tension is removed from the free end of the strap.

While straps of the two types described above have been found extremely effective and are in widespread use, they have the disadvantage of being relatively costly.

SUMMARY OF THE INVENTION

The present invention may be summarized as directed to a new, useful and inexpensive strapping or banding construction and the method of applying the same.

More particularly, the apparatus of the present invention comprises an elongate strip of readily bendable metal having formed at one end thereof an anchor portion comprised of a series of two or more convolutions of the band which have been bent at right angles to the band, which is rectangular in cross section. The convolutions are wound in such manner as to define a through-going passageway which is generally rectangular in section and which has an axis parallel to the longitudinal axis of the band.

Preferably the end of the band remote from the free end projects laterally of the band for a short distance, e.g. a distance of one or two times the width of the band.

The device is used by circling the band about an object or objects to be subjected to compressive forces and then passing the band through the passageway in the anchor portion. Thereafter tightening forces are applied by means which pull the free end of the band in a first direction and react against the convolutions defining the anchor, preferably the inner convolutions, to force said convolutions in a direction opposite the force exerted on the free end of the band. The result of the application of said tightening and reacting forces is to cause the convolutions defining the anchor to be tightly coiled about the portions of the band extending through the passageway. When the tightening forces are relieved, the band will not slip backwardly through the anchor.

The band may be locked in the tightened position by bending the free end of the band backwardly over the anchor and thereafter bending the laterally projecting portion adjacent the end opposite the free end over the above described bent-over portion of the band.

The invention further contemplates a method of attaching a band of the type described about articles to be subjected to inward compressive forces in accordance with the steps hereinabove set forth.

As a final installing step, the excess length of the band between the free end and the anchor may be cut away or broken off by repeatedly flexing the band about a transverse bending axis coincident with a side edge of the above described bent-over portion of the anchor forming end of the device.

Accordingly, it is an object of the invention to provide an inexpensive and effective clamping device formed of an integral metal strip or band which functions to lock a detent element of the band in position without the necessity for providing pawls, worms or like cost increasing expedients.

A further object of the invention is the provision of a method of attaching bands of the type described.

To attain these objects and such further objects as may appear herein or be hereinafter pointed out, reference is made to the accompanying drawings, forming a part hereof, in which:

FIGS. 1 to 6 comprise sequential perspective views illustrating the clamping device of the present invention at successive stages of its manufacture;

FIGS. 7 to 9 are fragmentary perspective views of the band at progressive stages of its application;

FIG. 10 is a magnified view taken on the line 10—10 of FIG. 9;

FIG. 11 is a magnified horizontal section taken on the line 11—11 of FIG. 9;

FIGS. 12 and 13 are magnified schematic vertical sectional views showing the position of the parts respectively in the pre-tightened and the tightened conditions of the clamp.

Referring now to the drawings, there is shown in FIG. 1 a band 10 from which the apparatus of the invention is fabricated. The band is fabricated from a metallic material which is readily bendable but not especially springy, i.e. which when bent about a sharp bending radius will hold its bent configuration without significant tendency to spring back to its original configuration. By way of example, any of a variety of stainless steels or galvanized steels may be suitably employed.

The band 10 includes elongate parallel side edges 11, 12, and includes a free end 13, the side edges of which are cut away to form a tongue portion 14 for purposes of facilitating insertion of the free end through the anchor portion to be hereinafter described.

Preferably the major length of the band is provided with a multiplicity of ridges or corrugations 15 which facilitate gripping of the band by a gripping or tightening tool.

The end 16 of the band opposite the free end may be dimpled, as at 17, so as to render the portion of the band in registry with the dimpled element more resistive to transverse bending forces than the remainder of the band and to form a grippable tab.

The anchor portion or eye 18 of the clamp device is formed by the simple expedient of wrapping the portions of the band adjacent the end 16 about the band in a series of convolutions, as progressively illustrated in FIGS. 2 to 6.

More particularly, as shown in FIG. 2, the eye is formed by first bending the portion 19 of the band so that it lies at right angles to the remainder of the band and progressively convoluting the portion 19 about the band, as shown in FIGS. 3 to 6 until the portion 19 is wrapped as tightly as possible, to define preferably at least two convolutions.

As will be observed in FIG 6, a short length 19' of the portion 19 remains in laterally projecting relation to the band after the wrapping operation is completed, the portion 19' including the dimpled member 17.

The device is employed by encircling the band about an object 20 to be compressed (FIGS. 7 to 9), the portion 19' being preferably disposed against the surface of the encircled item 20.

As will be appreciated from an inspection of FIGS. 10 to 13, the result of the wrapping operation is to provide a passageway 21 within the various convolutions 22, 23, the passageway 21 being of a cross-sectional size closely corresponding to the cross section of the band to permit the body portion of the strip to extend freely therethrough.

In order to form the passageway 21, the convolutions 22, 23 may be wrapped tightly about an appropriately sized mandrel which is rectangular in transverse section.

With the device positioned as shown in FIG. 7, the band is tightened by exerting a force in the direction of the arrow 24 (FIGS. 7 and 12) on the portion 25 of the band extending through the passageway while at the same time exerting a reacting force in the direction of the arrows 26, 26 (FIG. 12) against the convolutions, and particularly the inner convolution 22.

Apparatus suitable for simultaneously exerting the opposed forces is already well known. Generally speaking, such device comprises stop portions 27, 26 which may be butted against the convolutions and a clamping member (not shown) adapted to grip the strip, and particularly the corrugations 15 thereof.

Devices of this sort include a pawl angled to grip the corrugations 15 when the pawl is moved away from the anchor 18 in a tightening direction and to release the grip from the strip and corrugations when the pawl is moved toward the anchor.

Apparatuses of a suitable type are shown in one or more of the following U.S. Pat. No. 3,993,109, issued Nov. 23, 1976 and U.S. Pat. No. 3,169,560, issued Feb. 16, 1965.

Operation of the device typically includes sequential tightening and releasing of a pair of handles, with the result that a pawl is progressively brought into contact with the band and shifted away from the anchor when the handles are closed, the pawl being released and returned to a position closer to the anchor when the handles are released.

As is best seen from a comparison of FIGS. 12 and 13, the result of the application of forces in the directions 24 and 26 is to cause (after sufficient tension is present in the band) the convolutions of the anchor 18 to shift from a relatively loosely encircling position of the band into a tightly or intimately embracing position thereof. Thus, when the band has been tightened (FIG. 13), the anchor 18 is deformed from its original condition with the inner convolution 22 deflected downstream and into a tightly frictionally encircling relation of the components of the band lying within the anchor 18.

When the desired degree of tightness is achieved, and the tool carrying members 27 removed, the band will be retained within the anchor 18 and will not flow backwardly through the anchor notwithstanding the substantial tension which has been developed in the band.

In order permanently to lock the band in the tightened position, the portion 25 of the band is bent backward from the position shown in FIG. 7 to the position shown in FIG. 8, whereby no retro-movement of the portion 25 of the band is possible.

Preferably the portion 19' of the band is thereafter bent over the folded-back portion 25, as shown in FIGS. 9 to 11. If the remaining portion 25 which projects beyond the portion 19' is unduly long, such remaining portion may be bent back and forth, as shown in dotted lines, FIG. 11, about the side edge 28 of the portion 19' as a fulcrum, until the portion 25 is severed at the point 29, FIG. 11.

The resultant applied clamp or fastening member presents a neat appearance and will remain securely affixed in encircling relation of the selected object.

The device may be rapidly applied, the entire sequence of steps above recited being capable of being performed by a skilled operator in a matter of approximately ten seconds.

From the foregoing it will be readily recognized that there is described in accordance with the present invention an extremely simple and inexpensive yet highly efficient clamping band. Since the band is fabricated from a single length of metal and since the manufacturing operation involves, in substance, merely the wrapping of a series of convolutions about a mandrel, the same is readily susceptible of automated manufacture.

As will be apparent to those skilled in the art and acquainted with the present disclosure, numerous variations in details of construction and methods of application may be made without departing from the spirit of the invention. Accordingly, the same is to be broadly construed within the scope of the appended claims.

Having thus described the invention and illustrated its use, what is claimed as new and is desired to be secured by Letters Patent is:

1. As a new article of manufacture, a self-locking clamp band comprising an elongate, integral flexible metal strip having parallel side edge portions, said strip including a free end and an anchor portion at the other end, said anchor portion being defined by a plurality of turns of said strip folded normal to the longitudinal axis of said strip and convoluted about said strip, said plurality of turns defining a passage generally rectangular in transverse section and sized to permit the unimpeded passage therethrough of said free end, said anchor portion including a transversely extending locking tab defining the end of said strip remote from said free end and projecting laterally beyond said anchor portion, the convolutions defining said passage of said anchor portion being subject to constriction into gripping relation of said side edges of a length of said strip extending through said passage responsive to pressure exerted against said anchor portion in a direction axially of said strip.

2. The article of claim 1 wherein said strip includes a multiplicity of transversely directed corrugations extending substantially the entire length of said band between said free end and said anchor portion.

3. The article of claim 1 wherein said anchor portion is comprised of at least two substantially complete convolutions, said convolutions, prior to application of said axial pressure, lying in registry, said convolutions being shifted out of registry responsive to said axial pressure.

4. A clamp band in accordance with claim 1 wherein said passage is separated from said strip by not more than a single thickness of said strip.

* * * * *